US008636343B2

(12) United States Patent
Furihata

(10) Patent No.: US 8,636,343 B2
(45) Date of Patent: Jan. 28, 2014

(54) LIQUID EJECTING HEAD, LIQUID EJECTING APPARATUS, AND PIEZOELECTRIC ELEMENT

(71) Applicant: Seiko Epson Corporation, Tokyo (JP)

(72) Inventor: Hidemichi Furihata, Chino (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 13/718,053

(22) Filed: Dec. 18, 2012

(65) Prior Publication Data

US 2013/0155155 A1 Jun. 20, 2013

(30) Foreign Application Priority Data

Dec. 20, 2011 (JP) ..... 2011-278880

(51) Int. Cl.
*B41J 2/045* (2006.01)

(52) U.S. Cl.
USPC ..... 347/68; 347/71; 347/72

(58) Field of Classification Search
USPC ..... 347/68, 71, 72; 310/358, 311; 252/62.9 PZ
See application file for complete search history.

(56) References Cited

U.S. PATENT DOCUMENTS

2007/0241642 A1* 10/2007 Miyazawa et al. ..... 310/358

FOREIGN PATENT DOCUMENTS

| | | |
|---|---|---|
| JP | 2001-223404 | 8/2001 |
| JP | 2007-287745 | 11/2007 |

* cited by examiner

*Primary Examiner* — Matthew Luu
*Assistant Examiner* — Henok Legesse
(74) *Attorney, Agent, or Firm* — Harness, Dickey & Pierce, P.L.C.

(57) ABSTRACT

A liquid ejecting head contains a piezoelectric element having a piezoelectric layer and an electrode disposed on the piezoelectric layer, in which the piezoelectric layer contains a complex oxide containing bismuth, iron, barium, and titanium and having a perovskite structure, has a yield stress of 5.66 GPa or more, and has a Young's modulus of 114 GPa or more.

4 Claims, 11 Drawing Sheets

LIQUID EJECTING HEAD, LIQUID EJECTING APPARATUS, AND PIEZOELECTRIC ELEMENT

The entire disclosure of Japanese Patent Application No. 2011-278880, filed Dec. 20, 2011 is incorporated by reference herein.

BACKGROUND

1. Technical Field

The present invention relates to a liquid ejecting head having a piezoelectric element having a piezoelectric layer containing a piezoelectric material and an electrode, in which liquid droplets are discharged from a nozzle opening, a liquid ejecting apparatus, and a piezoelectric element.

2. Related Art

Mentioned as the piezoelectric element is a piezoelectric material which exhibits a mechanoelectric conversion function, e.g., one in which a piezoelectric layer (piezoelectric film) containing a crystallized dielectric material is sandwiched between two electrodes. Such a piezoelectric element is carried in a liquid ejecting head, for example, as an actuator apparatus of a bending vibration mode. Mentioned as a typical example of the liquid ejecting head is, for example, an ink jet recording head in which a part of pressure generating chambers communicating with nozzle openings for discharging ink droplets is constituted by a diaphragm, and the diaphragm is transformed by the piezoelectric element to pressurize ink in the pressure generating chambers to discharge the ink from the nozzle opening in the form of ink droplets. Mentioned as a piezoelectric element carried in such an ink jet recording head is, for example, one in which a uniform piezoelectric material layer is formed by a film forming technique over the entire surface of the diaphragm, and the piezoelectric material layer is cut into a shape corresponding to the pressure generating chambers by a lithographic method to thereby form the piezoelectric elements in such a manner as to be separated for each pressure generating chamber.

The piezoelectric material to be used as the piezoelectric layer constituting such a piezoelectric element is required to have high piezoelectric properties. Mentioned as a typical example of the piezoelectric material is lead zirconate titanate (PZT) (JP-A-2001-223404). However, from the viewpoint of environmental problems, a non-lead piezoelectric material or a piezoelectric material in which the lead content is reduced has been demanded. Mentioned as piezoelectric materials not containing lead are, for example, a $BiFeO_3$ piezoelectric material containing Bi, Fe, Ba, and Ti (e.g., JP-A-2007-287745).

When such a piezoelectric material containing Bi, Fe, Ba, and Ti is formed into a piezoelectric layer, there is a problem in that cracks are easily formed. When the piezoelectric layer has a portion directly disposed on the electrode (portion on a piezoelectric layer electrode) and a portion directly disposed on a member other than the electrode (portion other than a piezoelectric layer electrode), cracks are easily formed particularly in the portion other than the piezoelectric layer electrode. It is a matter of course that such a problem is not limited to the ink jet recording head and similarly arises in other liquid ejecting heads for discharging droplets of liquid other than ink and also in piezoelectric elements for use in members other than liquid ejecting heads.

SUMMARY

An advantage of some aspects of the invention is to provide a liquid ejecting head having a piezoelectric element having a piezoelectric layer in which an environmental load is small and the generation of cracks is suppressed, a liquid ejecting apparatus, and a piezoelectric element.

According to a first aspect of the invention for solving the above-described problem, a liquid ejecting head has a piezoelectric element having a piezoelectric layer and an electrode disposed on the piezoelectric layer, in which the piezoelectric layer contains a complex oxide containing bismuth, iron, barium, and titanium and having a perovskite structure, has a yield stress of 5.66 GPa or more, and has a Young's modulus of 114 GPa or more.

According to such an aspect, when the piezoelectric layer is formed in such a manner that the yield stress is 5.66 GPa or more and the Young's modulus is 114 GPa or more, the generation of cracks can be suppressed. Moreover, since lead is not contained or the lead content can be reduced, the load to the environment can be reduced.

According to a second aspect of the invention, a liquid ejecting apparatus has the above-described liquid ejecting head. In such an aspect, since the piezoelectric layer in which the generation of cracks is suppressed, the liquid ejecting apparatus has excellent reliability. Moreover, the load to the environment can be reduced.

According to a third aspect of the invention, a piezoelectric element has a piezoelectric layer and an electrode disposed on the piezoelectric layer, in which the piezoelectric layer contains a complex oxide containing bismuth, iron, barium, and titanium and having a perovskite structure, has a yield stress of 5.66 GPa or more, and has a Young's modulus of 114 GPa or more. According to such an aspect, when the piezoelectric layer is formed in such a manner that the yield stress is 5.66 GPa or more and the Young's modulus is 114 GPa or more, the generation of cracks can be suppressed. Moreover, since lead is not contained or the lead content can be reduced, the load to the environment can be reduced.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
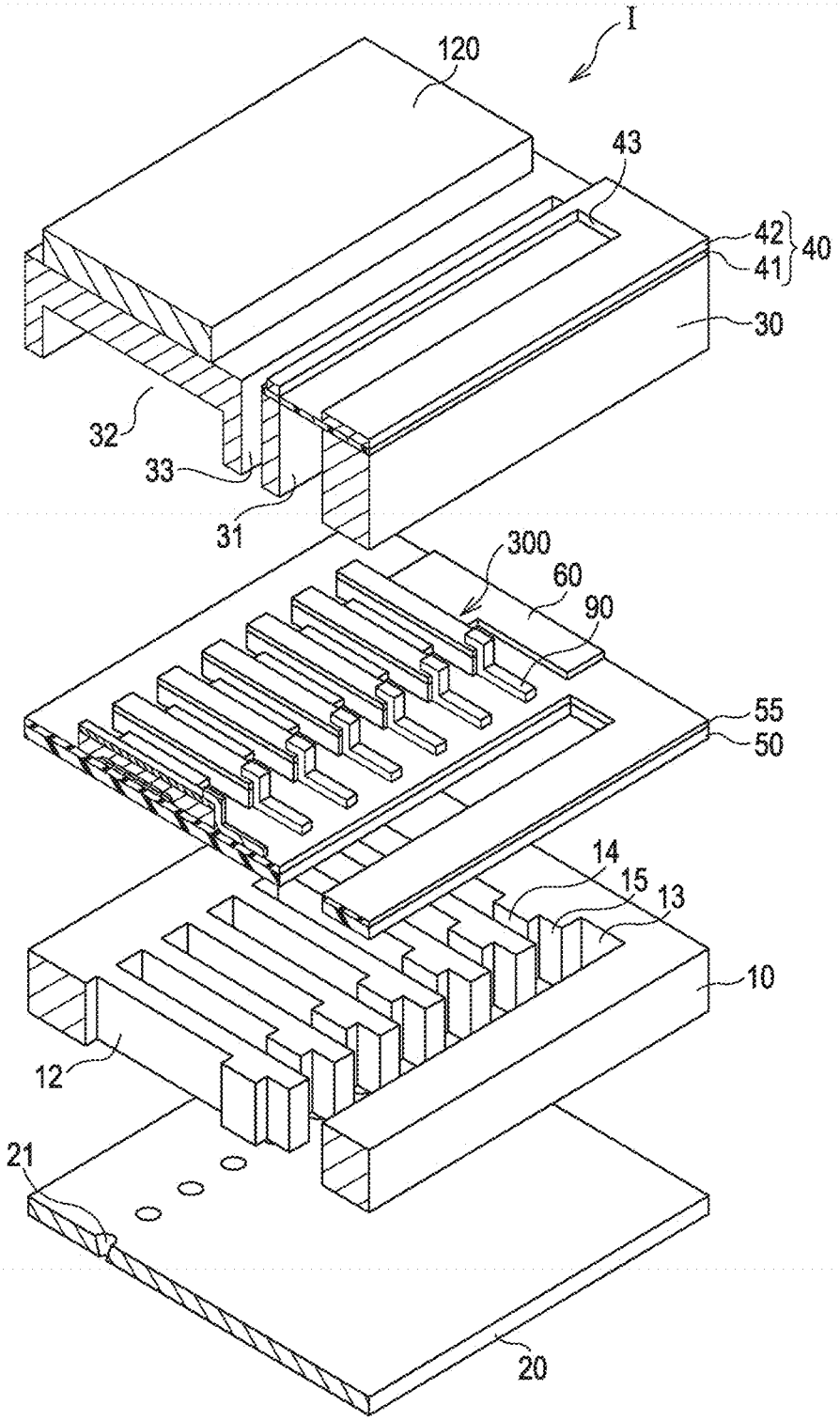
FIG. 1 is an exploded perspective view schematically illustrating the structure of a recording head according to First Embodiment.
Figure 2:
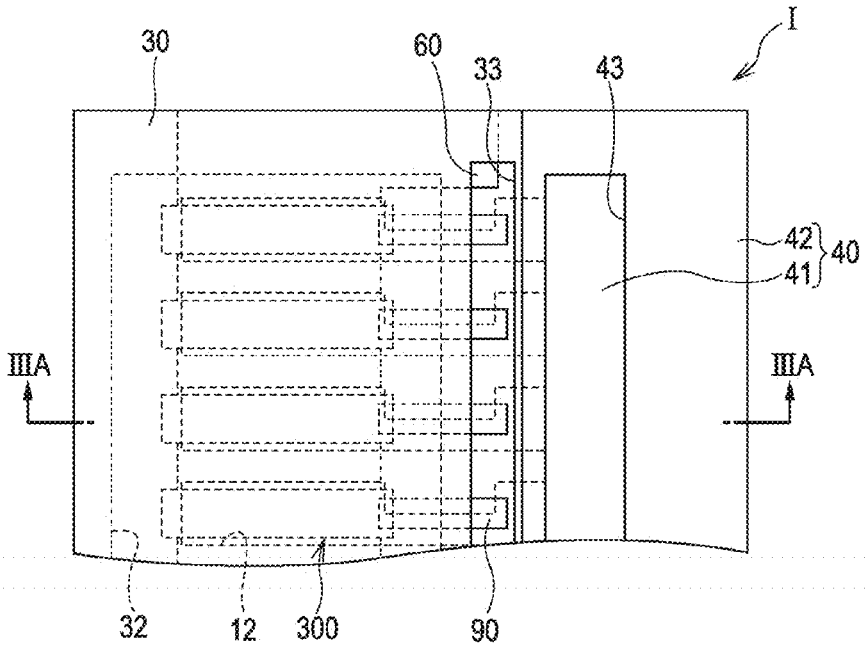
FIG. 2 is a plan view of the recording head according to First Embodiment.
Figure 3A:
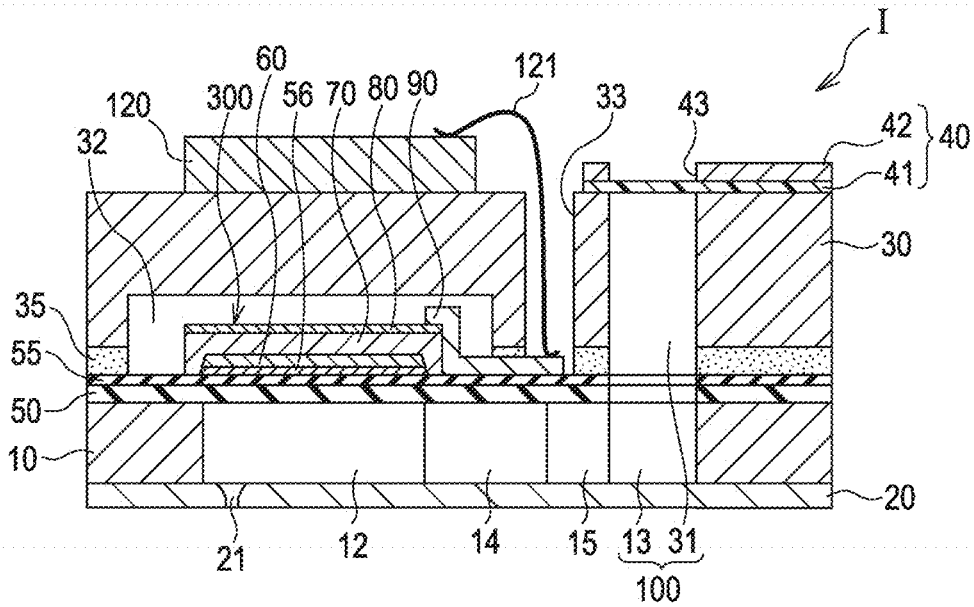
FIGS. 3A and 3B are a cross sectional view and an enlarged cross sectional view of the principal portion, respectively, of the recording head according to First Embodiment.
Figure 3B:
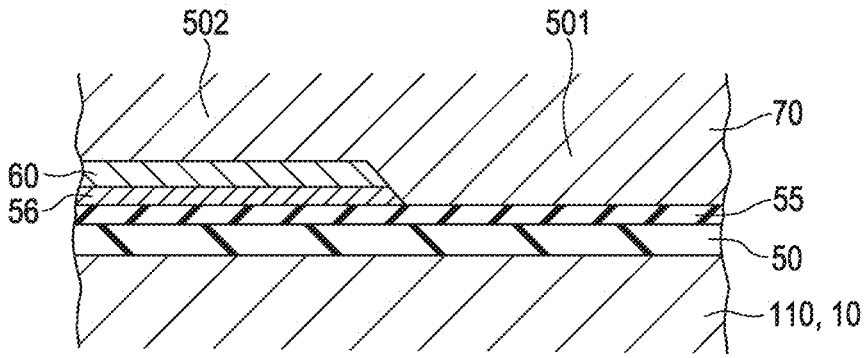

FIG. 1 is an exploded perspective view schematically illustrating the structure of an ink jet recording head which is one example of a liquid ejecting head according to First Embodiment of the invention. FIG. 2 is a plan view of FIG. 1. FIG. 3A is a cross sectional view along the IIIA-IIIA line of FIG. 2. FIG. 3B is an enlarged view of the principal portion of FIG. 3A. As illustrated in FIGS. 1 to 3, a flow path formation substrate 10 of this embodiment contains a silicon single crystal substrate, and an elastic film 50 containing silicon dioxide is formed on either one surface of the flow path formation substrate 10.

In the flow path formation substrate 10, a plurality of pressure generating chambers 12 are arranged in parallel in the width direction. A communication portion 13 is formed in a region at the outside in the longitudinal direction of the pressure generating chambers 12 of the flow path formation substrate 10, and the communication portion 13 and each pressure generating chamber 12 are made to communicate with each other through an ink supply path 14 and a communication path 15 provided in each pressure generating chamber 12. The communication portion 13 communicates with a manifold portion 31 described later to constitute a part of a manifold serving as a common ink chamber of the respective pressure generating chambers 12. The ink supply path 14 is formed with a width narrower than that of the pressure generating chambers 12 and maintains the flow path resistance of ink which flows into the pressure generating chambers 12 from the communication portion 13 at a fixed level. In this embodiment, the ink supply path 14 is formed by reducing the width of the flow path from one side but the ink supply path may be formed by reducing the width of the flow path from both sides. The ink supply path may be formed not by reducing the width of the flow path but by reducing the thickness thereof. In this embodiment, the flow path formation substrate 10 is provided with a liquid flow path containing the pressure generating chambers 12, the communication portion 13, the ink supply path 14, and the communication path 15.

To an opening surface side of the flow path formation substrate 10, a nozzle plate 20, in which nozzle openings 21 which communicate with the vicinity of the end portion at the side opposite to the ink supply path 14 of each pressure generating chamber 12 are formed, adheres with an adhesive, a thermal fusing film, or the like. The nozzle plate 20 contains, for example, glass ceramics, a silicon single crystal substrate, stainless steel, or the like.

On the other hand, at the side opposite to the opening surface of the flow path formation substrate 10, the elastic film 50 is formed as described above. On the elastic film 50, an insulator film 55 containing zirconium dioxide or the like having a thickness of about 400 nm is formed. On the insulator film 55, an adhesion layer 56 is provided which contains titanium oxide or the like having a thickness of about 10 to 50 nm and increases the adhesiveness with the foundation of a first electrode 60 of the elastic film 50 and the like.

Furthermore, on the adhesion layer 56, the first electrode 60, a piezoelectric layer 70 which is a thin film having a thickness of 3 μm or lower and preferably 0.3 to 1.5 μm, and a second electrode 80 are laminated to constitute a piezoelectric element 300 as a pressure generating unit for changing the pressure in the pressure generating chambers 12. Herein, the piezoelectric element 300 refers to a portion containing the first electrode 60, the piezoelectric layer 70, and the second electrode 80. In general, either one of the electrodes of the piezoelectric element 300 is used as a common electrode and the other electrode and the piezoelectric layer 70 are patterned for each pressure generating chamber 12. In this embodiment, the first electrode 60 is used as the common electrode of the piezoelectric element 300 and the second electrode 80 is used as individual electrodes of the piezoelectric element 300 and vice versa depending on a drive circuit or wiring. Herein, the piezoelectric element 300 and a diaphragm in which displacement occurs by the drive of the piezoelectric element 300 are collectively referred to as an actuator apparatus. In the example described above, the elastic film 50, the insulator film 55, the adhesion layer 56, and the first electrode 60 act as the diaphragm but it is a matter of course that the invention is not limited thereto. For example, the elastic film 50 or the insulator film 55 and the adhesion layer 56 may not be provided. It may be structured so that the piezoelectric element 300 itself substantially serves as a diaphragm.

The first electrode 60 and the second electrode 80 may contain materials which exhibit metallic conduction and, for example, can contain platinum, iridium, iridium oxide, or a lamination structure thereof.

In an aspect of the invention, a piezoelectric material constituting the piezoelectric layer 70 is a complex oxide containing bismuth (Bi), iron (Fe), barium (Ba), and titanium (Ti) and having a perovskite structure. In the perovskite structure, i.e., $ABO_3$ structure, 12 oxygen atoms are coordinated in the A site of the structure and, in the B site thereof, 6 oxygen atoms are coordinated to form a octahedron. Bi and Ba are located in the A site and Fe and Ti are located in the B site.

The complex oxide containing Bi, Fe, Ba, and Ti and having the perovskite structure is represented as a complex oxide having a perovskite structure of a mixed crystal of bismuth ferrate and barium titanate or a solid solution in which bismuth ferrate and barium titanate form a uniform solid solution. In the X ray diffraction pattern, bismuth ferrate and barium titanate are not solely detected.

Herein, bismuth ferrate and barium titanate each are known piezoelectric materials having the perovskite structure and bismuth ferrate and barium titanate having various compositions are known. For example, known as bismuth ferrate and barium titanate are, in addition to $BiFeO_3$ and $BaTiO_3$, one in which one of the elements (Bi, Fe, Ba, Ti, and O) is not contained or is excessively contained or one in which one of the elements is replaced by other elements. When bismuth ferrate and barium titanate are indicated in an aspect of the invention, one whose composition is different from the composition in terms of stoichiometry due to loss and excess and one in which one of the elements is replaced by other elements are also included in the range of bismuth ferrate and barium titanate insofar as the fundamental properties are not changed. The ratio of bismuth ferrate and barium titanate can also be variously changed.

The composition of the piezoelectric layer 70 containing a complex oxide having such a perovskite structure is expressed as a mixed crystal represented by the following formula (1), for example. Formula (1) can also be represented by the following formula (1'). Herein, Formulae (1) and (1') represent the composition based on the stoichiometry. As described above, insofar as the perovskite structure can be contained, not only inevitable changes in the composition due to lattice mismatch, oxygen deficiency, and the like but a partial replacement of the elements and the like are permitted. For example, when the stoichiometric ratio is 1, changes within 0.85 to 1.20 are permitted. Even when substances are different from each other when represented by formulae as follows, substances having the same ratio of the element in the A site and the element in the B site are sometimes considered to be the same complex oxide.

$$(1-x)[BiFeO_3]-x[BaTiO_3] \quad (1)$$

$$(0<x<0.40)$$

$$(Bi_{1-x}Ba_x)(Fe_{1-x}Ti_x)O_3 \quad (1')$$

$$(0<x<0.40)$$

The complex oxide constituting the piezoelectric layer 70 may further contain elements other than Bi, Fe, Ba, and Ti. As other elements, Mn, Co, Cr, and the like are mentioned, for example. It is a matter of course that, also in the case of a complex oxide containing other elements, it is necessary to have a perovskite structure.

When the piezoelectric layer 70 contains Mn, Co, and Cr, the complex oxide has a structure such that Mn, Co, and Cr are located in the B site. For example, when Mn is contained, the complex oxide constituting the piezoelectric layer 70 is expressed as a complex oxide having a structure in which a part of Fe of a solid solution in which bismuth ferrate and barium titanate form a uniform solid solution or having a perovskite structure of a mixed crystal of bismuth ferrate manganate and barium titanate. It is found that the fundamental properties are the same as those of the complex oxide having a perovskite structure of a mixed crystal of bismuth ferrate and barium titanate but the leak properties improve. Also when Co and Cr are contained, the leak properties improve similarly as in the case of containing Mn. In the X ray diffraction pattern, if bismuth ferrate, barium titanate, bismuth ferrate manganate, cobalt ferrate, bismuth ferrate, and bismuth ferrate chromate are not solely detected. The description is given taking Mn, Co, and Cr as an example but it is found that the leak properties similarly improve also when two elements of transition metal elements are simultaneously contained and the elements can be formed into the piezoelectric layer 70. Furthermore, other known additives may also be contained in order to improve the properties.

The piezoelectric layer 70 containing such a complex oxide containing Mn, Co, and Cr in addition to Bi, Fe, Ba, and Ti and having a perovskite structure is a mixed crystal represented by the following formula (2), for example. Formula (2) can also be represented by the following formula (2'). In Formulae (2) and (2'), M represents Mn, Co, or Cr. Herein, Formulae (2) and (2') represent the composition based on the stoichiometry. As described above, insofar as the perovskite structure can be contained, inevitable changes in the composition due to lattice mismatch, oxygen deficiency, and the like are permitted. For example, when the stoichiometric ratio is 1, changes within 0.85 to 1.20 are permitted. Even when substances are different from each other when represented by formulae as follows, substances having the same ratio of the element in the A site and the element in the B site are sometimes considered to be the same complex oxide.

$$(1-x)[Bi(Fe_{1-y}M_y)O_3]-x[BaTiO_3] \quad (2)$$

$$(0<x<0.40,\ 0.01<y<0.10)$$

$$(Bi_{1-x}Ba_x)((Fe_{1-y}M_y)_{1-x}Ti_x)O_3 \quad (2')$$

$$(0<x<0.40,\ 0.01<y<0.10)$$

In an aspect of the invention, the piezoelectric layer 70 has a yield stress of 5.66 GPa or more and a Young's modulus of 114 GPa or more. Thus, in the case of the piezoelectric layer 70 having a yield stress of 5.66 GPa or more and a Young's modulus of 114 GPa or more, the generation of cracks is suppressed. Therefore, a high-reliable ink jet recording head is obtained. When the yield stress of the piezoelectric layer 70 is 5.66 GPa or more but the Young's modulus thereof is lower than 114 GPa, the generation of cracks cannot be suppressed as in an aspect of the invention. When the Young's modulus of the piezoelectric layer 70 is 114 GPa or more but the yield stress is lower than 5.66 GPa, the generation of cracks cannot be suppressed as in an aspect of the invention.

Herein, as illustrated in FIG. 3B, particularly in a portion 501 other than the piezoelectric layer electrode which is a portion directly disposed on a member which is not the first electrode 60 in the piezoelectric layer 70 (on the insulator film 55 containing zirconium dioxide in this embodiment) has had a problem such that cracks are easily generated. When cracks are generated in the portion 501 other than the piezoelectric layer electrode, cracks are generated also in the foundation (the insulator film 55 in this embodiment) of the portion 501 other than the piezoelectric layer electrode due to the cracks generated in the portion 501. In an aspect of the invention, the generation of cracks can be suppressed also in the portion 501 other than the piezoelectric layer electrode by adjusting the yield stress and the Young's modulus of the piezoelectric layer 70 to be in the predetermined range. The structure such that the piezoelectric layer 70 has a portion 502 on the piezoelectric layer electrode which is disposed on the first electrode 60 and the portion 501 other than the piezoelectric layer electrode which is directly disposed on a member which is not the first electrode 60 is manufactured by a method including laminating the piezoelectric layer 70 and the second electrode 80 on the foundation of the insulator film 55 and the like on which the patterned first electrode 60 is disposed, for example.

Although described in detail later, by adjusting the materials and the manufacturing conditions of the insulator film 55, the first electrode 60, the elastic film 50, and the like on which the piezoelectric layer 70 is directly provided, the yield stress and the Young's modulus of the piezoelectric layer 70 can be adjusted in the predetermined range.

To each of the second electrodes 80 which are individual electrodes of such a piezoelectric element 300, a lead electrode 90 is connected which contains gold (Au) or the like and is drawn out from the vicinity of the end portion at the side of the ink supply path 14 to be extended to the insulator film 55, for example.

Onto the flow path formation substrate 10 on which such a piezoelectric element 300 is formed 60, i.e., on the first electrode, the elastic film 50, the insulator film 55, and the lead electrode 90, a protective substrate 30 having the manifold portion 31 constituting at least one part of the manifold 100 is bonded through an adhesive 35. In this embodiment, the manifold portion 31 is formed penetrating the protective substrate 30 in the thickness direction over the width direction of the pressure generating chambers 12 and is made to communicate with the communication portion 13 of the flow path formation substrate 10 to constitute the manifold 100 which serves as a common ink chamber of the respective pressure generating chamber 12 as described above. The communication portion 13 of the flow path formation substrate 10 may be divided into a plurality of parts for each pressure generating chamber 12, so that only the manifold portion 31 may be used as a manifold. Furthermore, for example, only the pressure generating chambers 12 may be provided in the flow path formation substrate 10, and the ink supply paths 14 communicating with the manifold 100 and each pressure generating chamber 12 may be provided in a member (e.g., the elastic film 50, the insulator film provided, etc.) interposed between the flow path formation substrate 10 and the protective substrate 30.

In a region facing the piezoelectric element 300 of the protective substrate 30, a piezoelectric element holding portion 32 is provided which has a space large enough not to inhibit the movement of the piezoelectric element 300. The piezoelectric element holding portion 32 may have a space large enough not to inhibit the movement of the piezoelectric element 300, and the space may be or may not be sealed.

As such a protective substrate 30, materials having substantially the same coefficient of thermal expansion as that of the flow path formation substrate 10, e.g., glass and ceramic materials, are preferably used. In this embodiment, a silicon single crystal substrate which is the same material as that of the flow path formation substrate 10 is used for the formation thereof.

The protective substrate 30 is provided with a through hole 33 penetrating the protective substrate 30 in the thickness direction. The vicinity of the end portion of the lead electrode 90 drawn out from each piezoelectric element 300 is provided in such a manner as to be exposed to the inside of the through hole 33.

Onto the protective substrate 30, a drive circuit 120 for driving the piezoelectric elements 300 arranged in parallel is fixed. As the drive circuit 120, a circuit substrate, a semiconductor integrated circuit (IC), or the like can be used, for example. The drive circuit 120 and the lead electrode 90 are electrically connected through a connection wiring 121 containing an electrically conductive wire, such as a bonding wire.

Onto such a protective substrate 30, a compliance substrate 40 containing a sealing film 41 and a fixation plate 42 is bonded. Herein, the sealing film 41 contains a material having a low rigidity and flexibility, and the sealing film 41 seals one surface of the manifold portion 31. The fixation plate 42 is formed with a relatively hard material. A region facing the manifold 100 of the fixation plate 42 is completely removed in the thickness direction to form an opening portion 43, and therefore one surface of the manifold 100 is sealed only by the sealing film 41 having flexibility.

In such an ink jet recording head I of this embodiment, ink is taken in from an ink introduction port connected to an ink supply unit (not illustrated) at the outside, the inside of a space from the manifold 100 to the nozzle opening 21 is filled with the ink, and thereafter a voltage is applied between the first electrode 60 and the second electrode 80 corresponding to each of the pressure generating chambers 12 in accordance with a recording signal from the drive circuit 120 to bend and transform the elastic film 50, the adhesion layer 56, the first electrode 60, and the piezoelectric layer 70, so that the pressure in each pressure generating chamber 12 increases, and ink droplets are discharged from the nozzle openings 21.

Next, an example of a method for manufacturing the ink jet recording head of this embodiment is described with reference to FIGS. 4 to 8. FIGS. 4 to 8 are cross sectional views in the longitudinal direction of the pressure generating chamber.

Figure 4A:
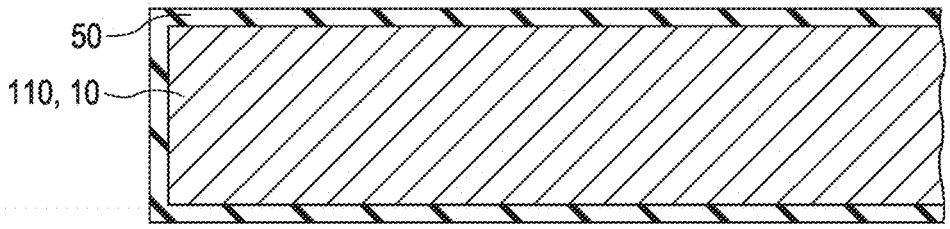
FIGS. 4A to 4C are cross sectional views illustrating manufacturing processes of the recording head according to First Embodiment.

First, as illustrated in FIG. 4A, a silicon dioxide film containing silicon dioxide ($SiO_2$) or the like constituting the elastic film 50 is formed by thermal oxidation or the like on the surface of a flow path formation substrate wafer 110 which is a silicon wafer.

Figure 4B:
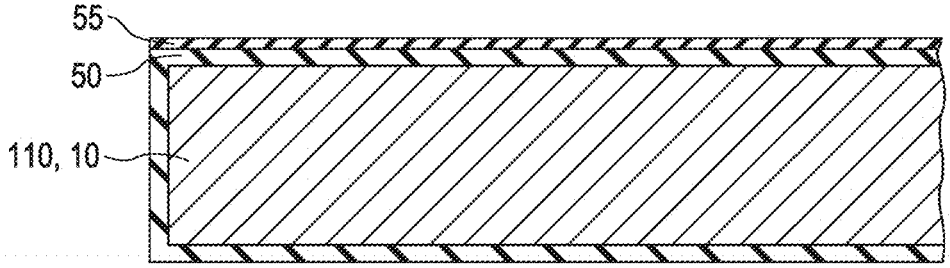

Subsequently, as illustrated in FIG. 4B, the insulator film 55 is formed on the elastic film 50 (silicon dioxide film) by thermal oxidation, reactive sputtering, or the like. Although described later in detail, a part of the piezoelectric layer 70 is directly formed on the insulator film 55 in this embodiment. By adjusting the material quality and the manufacturing conditions of this insulator film 55, the yield stress and the Young's modulus of the piezoelectric layer 70 can be adjusted to be in the range mentioned above.

For example, when forming the insulator film 55 containing zirconium oxide by thermal oxidation, the insulator film 55 is obtained by forming a zirconium film, and then oxidizing the same. When the zirconium film is formed by a sputtering method, for example, at this time, the zirconium film is formed into a convex shape such that the upper surface side of the formed film slightly projects by the compressive stress to be generated. Next, when the zirconium film is heated and oxidized, the convex shape is relieved by tensile stress to be generated, so that the insulator film 55 containing the zirconium dioxide to be formed can be almost flattened, for example. When further subjected to furnace annealing by a heat treatment furnace, for example, from this state, the insulator film 55 containing zirconium oxide is formed into a concave shape such that the upper surface side of the formed film forms a concave shape due to tensile stress to be generated. Thus, the stress of the insulator film 55 containing zirconium oxide varies depending on the manufacturing stage, and varies depending on the manufacturing conditions, such as heating temperature and time. Furthermore, the stress of the insulator film 55 also varies depending on the quality of materials constituting the insulator film 55. By adjusting the type and level of the stress of the insulator film 55, the yield stress and the Young's modulus of the piezoelectric layer 70 to be disposed on the film can be adjusted to desired values. When the insulator film 55 is manufactured under the manufacturing conditions under which the Young's modulus and the yield stress of the piezoelectric layer 70 directly formed on the insulator film 55, i.e., the portion 501 other than the piezoelectric layer electrode, the state of the stress of the insulator film 55 varies as described above but the Young's modulus and the yield stress of the insulator film 55 hardly vary.

Figure 4C:
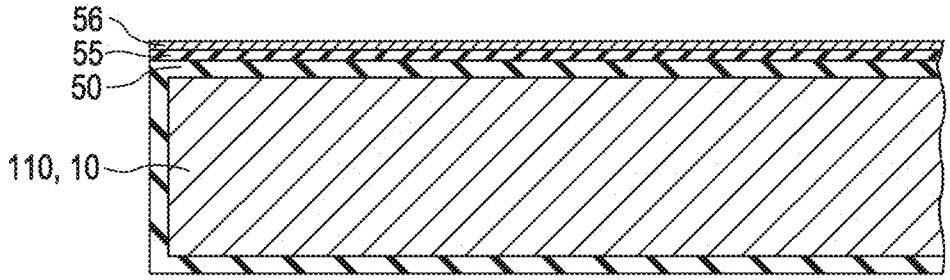

Next, as illustrated in FIG. 4C, the adhesion layer 56 containing titanium oxide or the like is formed on the insulator film 55 by a sputtering method, thermal oxidation, or the like.

Figure 5A:
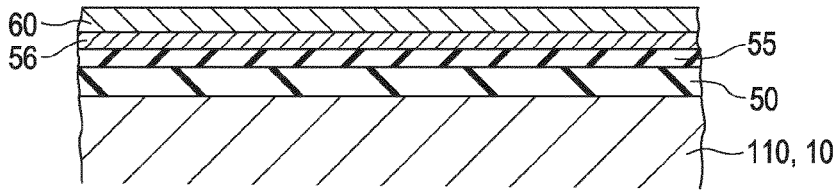
FIGS. 5A to 5C are cross sectional views illustrating manufacturing processes of the recording head according to First Embodiment.
Figure 5B:
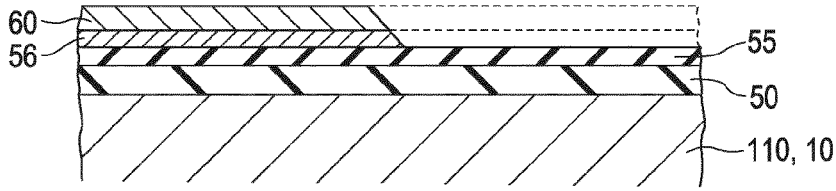

Next, as illustrated in FIG. 5A, the first electrode 60 containing platinum, iridium, iridium oxide, or a lamination structure thereof is formed on the entire surface of the adhesion layer 56 by a sputtering method, a vapor deposition method, or the like. Next, as illustrated in FIG. 5B, the adhesion layer 56 and the first electrode 60 are simultaneously patterned using a resist of a predetermined shape (not illustrated) as a mask on the first electrode 60 in such a manner that the side surfaces of the adhesion layer 56 and the first electrode 60 incline.

Subsequently, after separating the resist, the piezoelectric layer 70 is laminated on the first electrode 60. In this embodiment, the elastic film 50 and the insulator film 55 are formed on the entire surface in order, and then the piezoelectric layer 70 is laminated on the flow path formation substrate wafer 110 having the first electrode 60 which is patterned into a desired shape. Therefore, it is structured so that the piezoelectric layer 70 to be manufactured has the portion 502 on the piezoelectric layer electrode disposed on the first electrode 60 and the portion 501 other than the piezoelectric layer electrode directly disposed on the insulator film 55 which is a member which is not the first electrode 60. The manufacturing method for the piezoelectric layer 70 is not particularly limited. For example, the piezoelectric layer 70 can be manufactured using chemical solution methods, such as an MOD (Metal-Organic Decomposition) method and a sol-gel method, in which a solution containing a metal complex is applied, dried, and further fired at a high temperature, thereby obtaining a piezoelectric layer (piezoelectric film) containing metal oxide. In addition thereto, the piezoelectric layer 70 can be manufactured also by gaseous phase methods, liquid phase methods, and solid phase methods, such as a laser ablation method, a sputtering method, a pulsed laser deposition method (PLD method), a CVD method, and an aerosol deposition method.

Figure 5C:
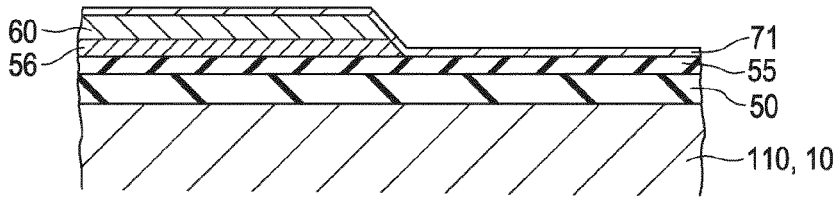

As a specific example of a formation procedure in the case of forming the piezoelectric layer 70 by the chemical solution method, first, a piezoelectric film formation composition (precursor solution) containing an MOD solution or a sol containing metal complexes, specifically metal complexes containing Bi, Fe, Ba, and Ti, is applied onto the first electrode 60 using a spin coat method or the like to thereby form a piezoelectric precursor film 71 as illustrated in FIG. 5C (application process).

The precursor solution to apply is one obtained by mixing metal complexes capable of forming complex oxides containing Bi, Fe, Ba, and Ti by firing, and dissolving or dispersing the mixture in organic solvents. When forming the piezoelectric layer 70 containing complex oxides containing Mn, Co, and Cr, a precursor solution further containing metal complexes containing Mn, Co, and Cr is used. The mixing ratios of the metal complexes containing each of Bi, Fe, Ba, and Ti and the metal complexes containing Mn, Co, and Cr, which are mixed as required, may be determined in such a manner that each metal achieves a desired molar ratio. As the metal complexes containing each of Bi, Fe, Ba, Ti, Mn, Co, and Cr, an alkoxide, an organic acid salt, a β diketone complex, and the like can be used, for example. As the metal complexes containing Bi, bismuth 2-ethylhexanoate, bismuth acetate, and the like are mentioned, for example. As the metal complexes containing Fe, iron 2-ethylhexanoate, iron acetate, iron tris(acetylacetonato), and the like are mentioned, for example. As the metal complexes containing Ba, barium isopropoxide, barium 2-ethyl hexanoate, barium acetylacetonato, and the like are mentioned, for example. As the metal complexes containing Ti, titanium isopropoxide, titanium 2-ethyl hexanoate, titanium(di-i-propoxide)bis(acetylacetonato), and the like are mentioned, for example. As the metal complexes containing Mn, manganese 2-ethylhexanoate, manganese acetate, and the like are mentioned, for example. As the metal complexes containing Co, cobalt 2-ethylhexanoate, cobalt (III) acetylacetonato, and the like are mentioned, for example. As the metal complexes containing Cr, chromium 2-ethyl hexanoate and the like are mentioned. It is a matter of course that metal complexes containing two or more elements of Bi, Fe, Ba, and Ti, and Mn, Co, and Cr, which are added as required, may be used. Mentioned as the solvent of the precursor solution are propanol, butanol, pentanol, hexanol, octanol, ethylene glycol, propylene glycol, octane, decane, cyclohexane, xylene, toluene, tetrahydrofurane, acetic acid, octylic acid, and the like.

Subsequently, the piezoelectric precursor film 71 is heated to a predetermined temperature (e.g., 150 to 200° C.), and then dried for a given period of time (drying process). Next, the dried piezoelectric precursor film 71 is heated to a predetermined temperature (e.g., 350 to 450° C.), and then held for a given period of time for degreasing (degreasing process). The degreasing as used herein is to remove the organic components contained in the piezoelectric precursor film 71 as $NO_2$, $CO_2$, $H_2O$, and the like, for example. The atmosphere of the drying process and the degreasing process is not limited, and the processes may be performed in the atmosphere, oxygen environment, or inactive gas. The application process, the drying process, and the degreasing process may be performed two or more times.

Figure 6A:
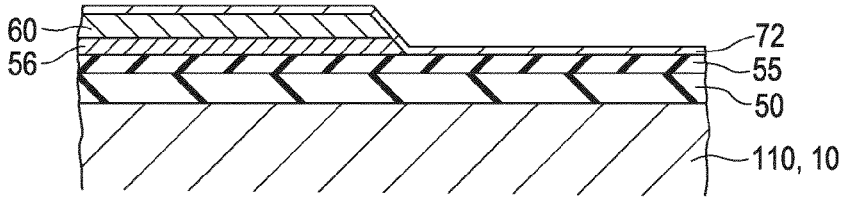
FIGS. 6A and 6B are cross sectional views illustrating manufacturing processes of the recording head according to First Embodiment.

Next, as illustrated in FIG. 6A, the piezoelectric precursor film 71 is heated to a predetermined temperature, e.g., about 600 to 850° C., and then held for a given period of time, e.g., 1 to 10 minutes, for crystallization, thereby forming a piezoelectric film 72 containing a complex oxide containing bismuth, iron, barium, and titanium and having a perovskite structure (firing process). Also in this firing process, the atmosphere is not limited and the firing process may be performed in the atmosphere, oxygen environment, or inactive gas. As a heating device for use in the drying process, the degreasing process, and the firing process, an RTA (Rapid Thermal Annealing) device which heats by irradiation of an infrared lamp, a hot plate, and the like are mentioned, for example.

Figure 6B:
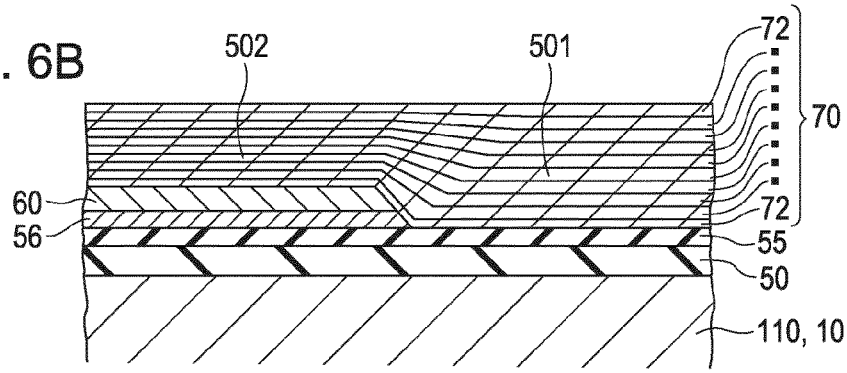

Subsequently, the application process, the drying process, and the degreasing process described above or the application process, the drying process, the degreasing process, and the firing process described above are repeated two or more times in accordance with a desired film thickness to thereby form the piezoelectric layer 70 containing a plurality of the piezoelectric films 72, thereby forming the piezoelectric layer 70 having a predetermined thickness containing a plurality of the piezoelectric films 72 as illustrated in FIG. 6B. For example, when the film thickness per application of the application solution is about 0.1 μm, the film thickness of the entire piezoelectric layer 70 containing 10 layers of the piezoelectric films 72 is about 1.1 μm. In this embodiment, the piezoelectric films 72 are laminated, but providing only one piezoelectric film 72 may be acceptable.

The piezoelectric layer 70 thus provided is disposed on the insulator film 55 which is formed by oxidizing zirconium and is a film containing zirconium dioxide formed under predetermined manufacturing conditions in this embodiment. Therefore, the yield stress can be adjusted to 5.66 GPa or more and the Young's modulus can be adjusted to 114 GPa or more.

When forming the piezoelectric layer 70, there has been a problem heretofore such that cracks are easily generated in the piezoelectric layer 70 to be formed, particularly cracks are easily generated in the piezoelectric layer 70 directly provided on a member which is not the first electrode 60, such as the insulator film 55, (the portion 501 other than the piezoelectric layer electrode). However, in an aspect of the invention, since the yield stress is 5.66 GPa or more and the Young's modulus is 114 GPa or more, the generation of cracks can be suppressed over the piezoelectric layer 70.

Figure 7A:
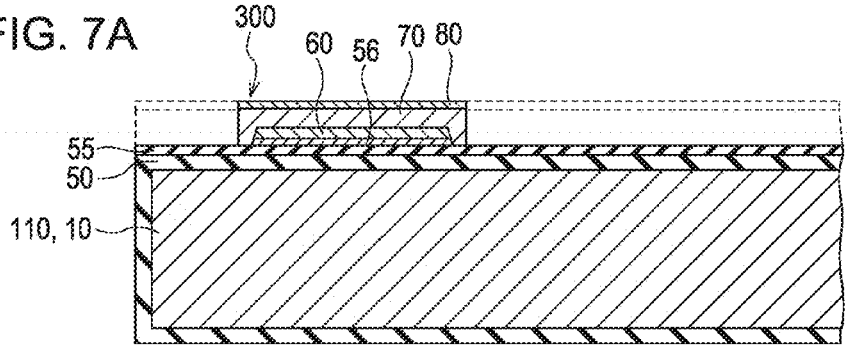
FIGS. 7A to 7C are cross sectional views illustrating manufacturing processes of the recording head according to First Embodiment.

After forming the piezoelectric layer 70 as described above, the second electrode 80 containing platinum or the like is formed on the piezoelectric layer 70 by a sputtering method or the like, and then the piezoelectric layer 70 and the second electrode 80 are simultaneously patterned in a region facing each pressure generating chamber 12 to thereby form the piezoelectric element 300 containing the first electrode 60, the piezoelectric layer 70, and the second electrode 80 as illustrated in FIG. 7A. In the patterning of the piezoelectric layer 70 and the second electrode 80, the patterning can be collectively carried out by dry etching the same through a resist (not illustrated) formed into a predetermined shape. Thereafter, annealing may be performed as required in a temperature range of 600 to 850° C., for example. Thus, a good interface of the piezoelectric layer 70 and the first electrode 60 or the second electrode 80 can be formed and the crystallinity of the piezoelectric layer 70 can be made high.

Figure 7B:
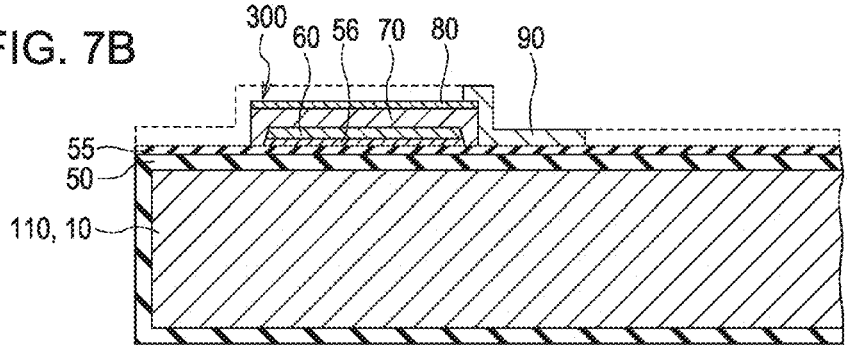

Next, as illustrated in FIG. 7B, the lead electrode 90 containing gold (Au) or the like, for example, is formed on the entire surface of the flow path formation substrate wafer 110, and then patterned for each piezoelectric element 300 through a mask pattern (not illustrated) containing a resist or the like.

Figure 7C:
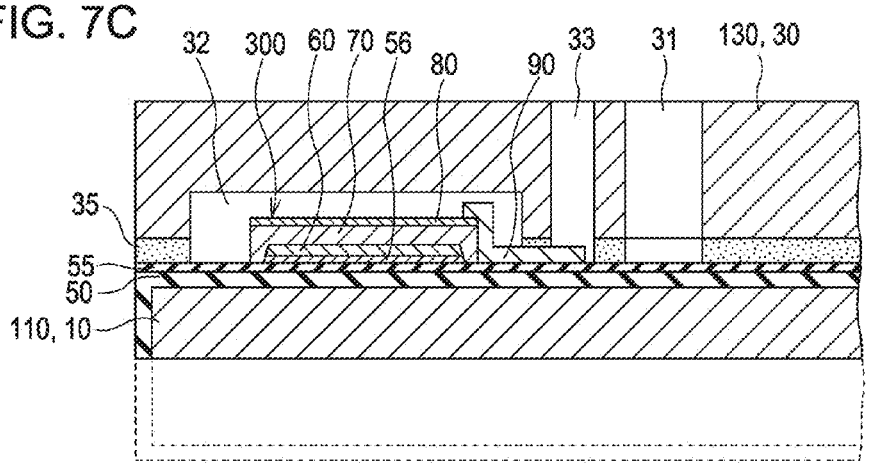

Next, as illustrated in FIG. 7C, a protective substrate wafer 130 which is a silicon wafer and serves as a plurality of the protective substrates 30 is formed through the adhesive 35 at the piezoelectric element 300 side of the flow path formation substrate wafer 110, and then the thickness of the flow path formation substrate wafer 110 is reduced to a predetermined thickness.

Figure 8A:
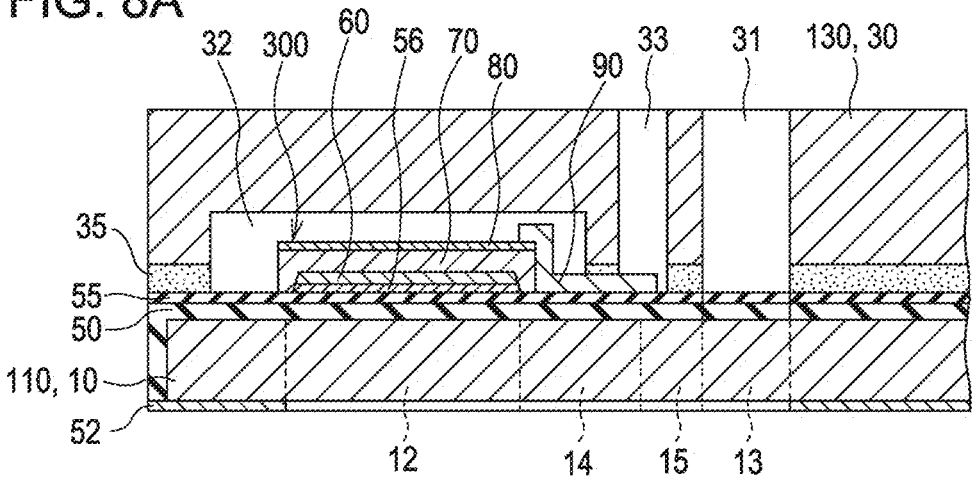
FIGS. 8A and 8B are cross sectional views illustrating manufacturing processes of the recording head according to First Embodiment.

Next, as illustrated in FIG. 8A, a mask film 52 is newly formed on the flow path formation substrate wafer 110, and then patterned into a predetermined shape.

Figure 8B:
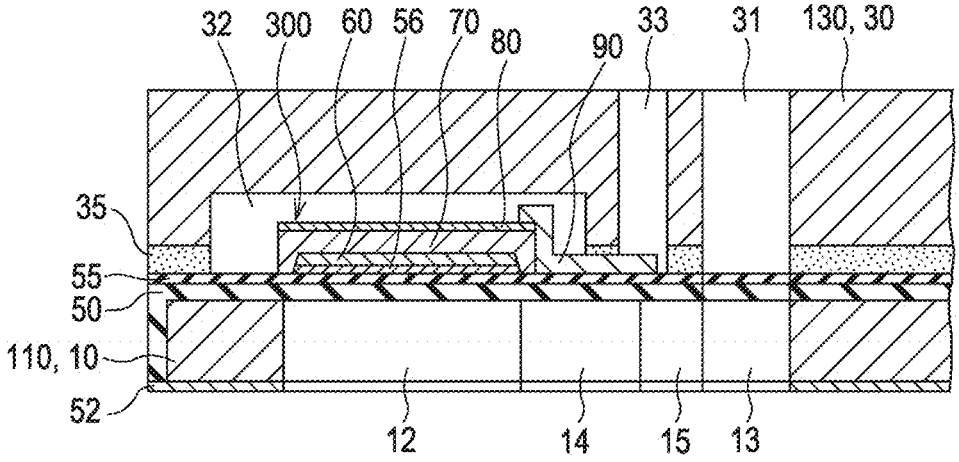

Then, as illustrated in FIG. 8B, by anisotropically etching (wet etching) the flow path formation substrate wafer 110 using an alkaline solution, such as KOH, through the mask film 52, the pressure generating chamber 12, the communication portion 13, the ink supply path 14, the communication path 15, and the like corresponding to the piezoelectric element 300 are formed.

Thereafter, unnecessary portions of the outer peripheral edge portion of the flow path formation substrate wafer 110 and the protective substrate wafer 130 are removed by cutting the same by dicing or the like, for example. Then, by bonding the nozzle plate 20 in which the nozzle openings 21 are formed after removing the mask film 52 at the surface opposite to the protective substrate wafer 130 of the flow path formation substrate wafer 110 and also bonding a compliance substrate 40 to the protective substrate wafer 130, and then dividing the flow path formation substrate wafer 110 and the like into the flow path formation substrate 10 and the like of one chip size as illustrated in FIG. 1, the ink jet recording head I of this embodiment is obtained.

EXAMPLES

Hereinafter, the invention is further specifically described with reference to Examples. The invention is not limited to the following Examples.

Example 1

First, an elastic film 50 containing silicon oxide ($SiO_2$) having a film thickness of 1100 nm by thermal oxidation was formed on the surface of a (100) single crystal silicon (Si) substrate. Next, a 270 nm thick zirconium film was formed on the elastic film 50 by a DC sputtering method. Thereafter, the zirconium film was thermally oxidized at 900° C. for 5 seconds by an RTA device, whereby an insulator film 55 containing zirconium dioxide having a thickness of 400 nm was formed.

Subsequently, a titanium film having a film thickness of 40 nm was formed on the insulator film 55 by an RF magnetron sputtering method, and then thermally oxidized, thereby forming an adhesion layer 56 containing titanium oxide. Next, a first electrode 60 containing a platinum film which is oriented in the (111) plane and has a thickness of 100 nm was formed on the adhesion layer 56 by an RF magnetron sputtering method.

Next, the adhesion layer 56 and the first electrode 60 were simultaneously patterned using a resist having a predetermined shape as a mask on the first electrode 60.

Subsequently, a piezoelectric layer 70 was formed on the silicon substrate on which the elastic film 50, the insulator film 55, the adhesion layer 56, and the first electrode 60 were laminated in order, i.e., the surface of the first electrode 60 and the insulator film 55. The technique is as follows. First, n-octane solutions of bismuth 2-ethylhexanoate, iron 2-ethylhexanoate, manganese 2-ethylhexanoate, barium 2-ethylhexanoate, and titanium 2-ethylhexanoate, were mixed in such a manner that the ratio of each element achieved Bi:Ba:Fe:Ti:Mn=75:25:71.25:25:3.75 in terms of molar ratio to thereby prepare a precursor solution.

Then, the precursor solution was added dropwise onto the surface of the first electrode 60 and the insulator film 55, and the substrate was rotated at 3000 rpm, thereby forming a piezoelectric precursor film (application process). Next, drying was performed at 180° C. for 2 minutes (drying process). Subsequently, degreasing was performed at 350° C. for 2 minutes (degreasing process). After a process including the application process, the drying process, and the degreasing process was repeatedly performed 3 times, firing was performed at 750° C. for 5 minutes in an oxygen atmosphere by an RTA device (firing process). Subsequently, a process including repeating the application process, the drying process, and the degreasing process 3 times, and thereafter performing the firing process for collectively firing was repeated 4 times, thereby forming the piezoelectric layer 70 containing piezoelectric films obtained by the 12 application processes in total and having a thickness on the first electrode 60 of 900 nm.

Thereafter, a second electrode containing a platinum film having a thickness of 100 nm was formed as the second electrode 80 on the piezoelectric layer 70 by a sputtering method, thereby forming a piezoelectric element 300 containing a complex oxide containing Bi, Fe, Mn, Ba, and Ti and having a perovskite structure as the piezoelectric layer 70.

Comparative Example 1

The same operation as in Example 1 was performed, except forming a zirconium film, thermally oxidizing the zirconium film at 900° C. for 5 seconds by an RTA device, and then further heating the same in a 850° C. diffusion furnace for 1 hour to thereby form the insulator film 55 containing zirconium oxide.

Test Example 1

Figure 9A:
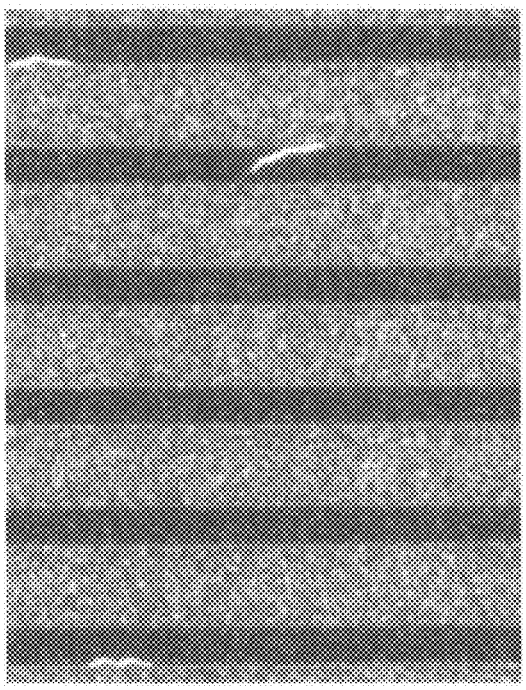
FIGS. 9A and 9B are photographs showing the results of observing the surface of piezoelectric elements of Example and Comparative Example.
Figure 9B:
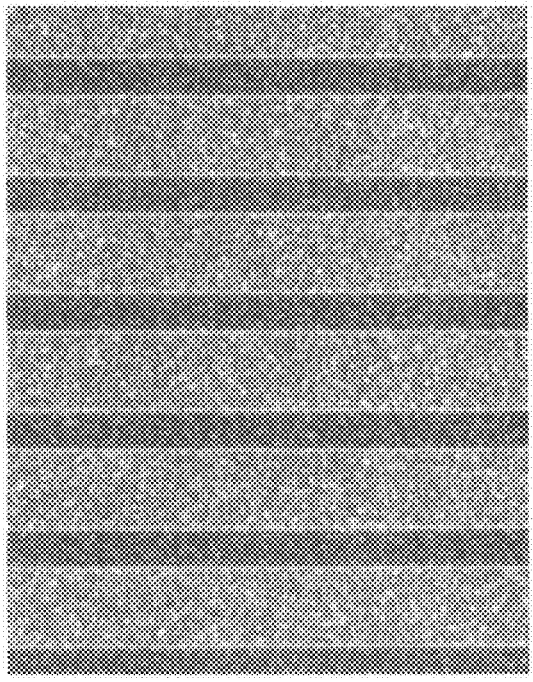

In Example 1 and Comparative Example 1, when the piezoelectric layer 70 was formed, the surface was observed under a metallurgical microscope at a magnification of 100. A photograph of Comparative Example 1 is shown in FIG. 9A and a photograph of Example 1 is shown in FIG. 9B. In FIG. 9, since the piezoelectric layer 70 is transparent, the first electrode 60 and the insulator film 55 which are the foundations can be observed. Then, the gray portion is the first electrode 60, the black portion is the insulator film 55, and the white portions are cracks generated in the piezoelectric layer 70. As illustrated in FIG. 9, cracks were not observed at all in Example 1 but, in Comparative Example 1, several cracks were observed in the portion directly disposed on the insulator film 55 of the piezoelectric layer 70, i.e., the portion 501 other than the piezoelectric layer electrode.

Test Example 2

In the piezoelectric elements of Example 1 and Comparative Example 1, when the piezoelectric layer 70 was formed, the piezoelectric layers 70 were measured for the yield stress and the Young's modulus of the portion 501 other than the piezoelectric layer electrode which is the portion directly disposed on the insulator film 55 containing zirconium oxide and the portion 502 on the piezoelectric layer electrode which is the portion disposed on the first electrode 60 under the following conditions using a nanoindenter (UMIS2000 manufactured by CSIRO). To the yield stress, a value of the perfect elastic region was applied. The results are shown in Table 1 and FIGS. 10A and 10B.

Spherical indenter: Diameter of 1 μm LA
Initial contact load: 0.03 mN
Maximum load: 0.5 mN
Load/Unload Increments: 20 (Linear)
Unloading to: 70% of max
Enable unload on increments: Unload Increments 1
Dwell: 1 sec
Indent Delay: 30 sec
n=20

Figure 10A:
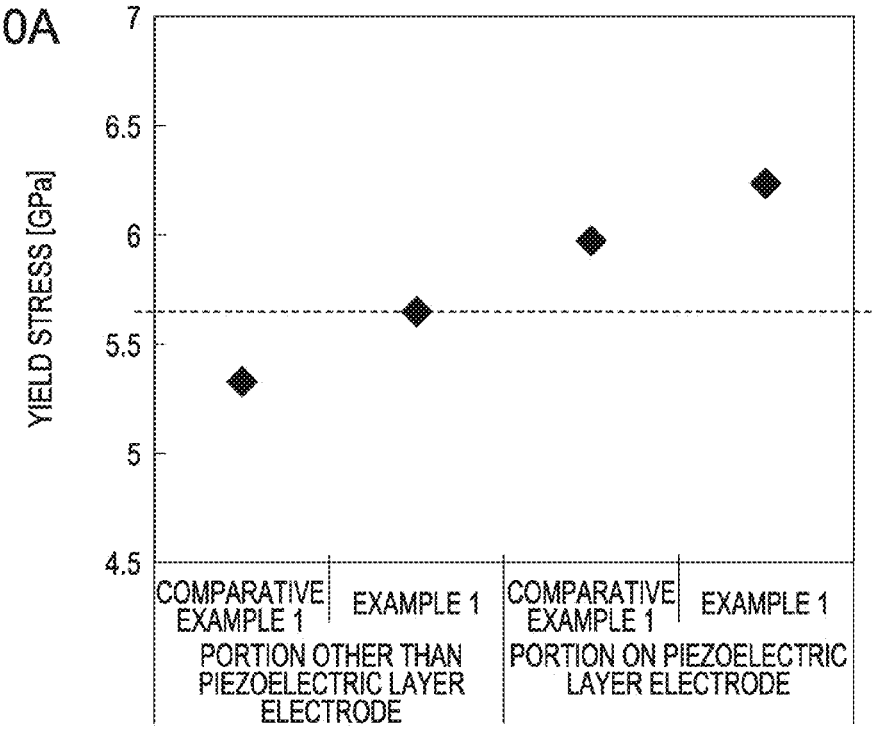
FIGS. 10A and 10B illustrate the measurement results of the yield stress and the Young's modulus, respectively, of piezoelectric layers of Example and Comparative Example.
Figure 10B:
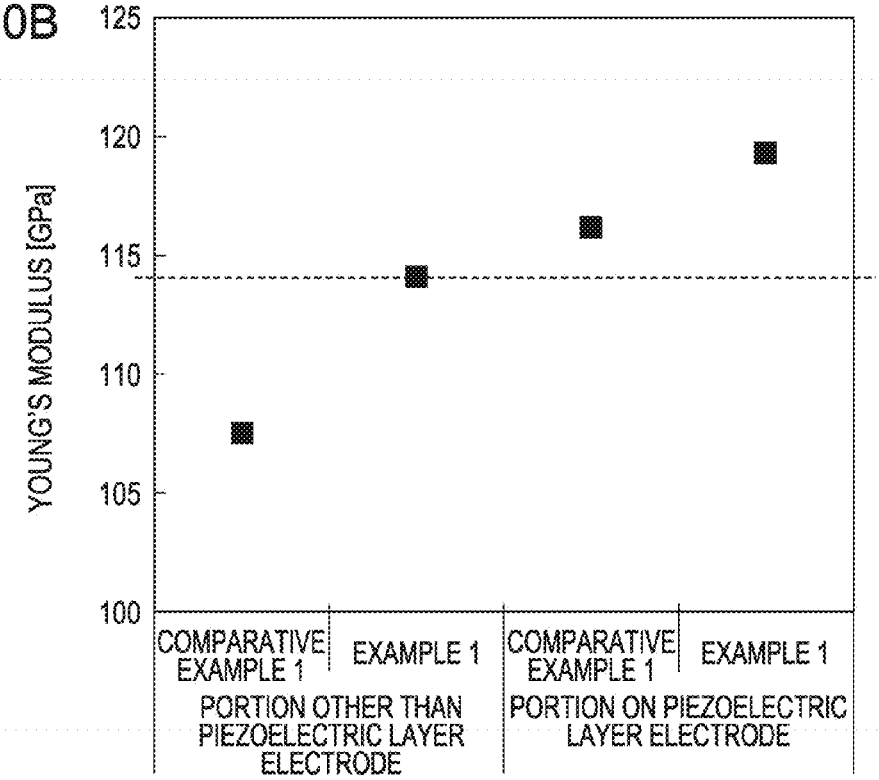

As a result, as shown in Table 1 and FIGS. 10A and 10B, both the portion 501 other than the piezoelectric layer electrode and the portion 502 on the piezoelectric layer electrode had a yield stress of 5.66 GPa or more and a Young's modulus of 114 GPa or more in Example 1. On the other hand, in Comparative Example 1, the portion 501 other than the piezoelectric layer electrode had a yield stress of lower than 5.66 GPa and a Young's modulus of lower than 114 GPa.

It can be said from the results of Test Examples 1 and 2 that, when the piezoelectric layer 70 has a yield stress of 5.66 GPa or more and a Young's modulus of 114 GPa or more, the generation of cracks is notably suppressed.

TABLE 1

| | Portion 501 other than piezoelectric layer electrode (on zirconium oxide) | | Portion 502 on piezoelectric layer electrode (on platinum) | |
|---|---|---|---|---|
| | Yield Stress [GPa] | Young's modulus [GPa] | Yield Stress [GPa] | Young's modulus [GPa] |
| Comparative Example 1 | 5.33 | 108 | 5.98 | 116 |
| Example 1 | 5.66 | 114 | 6.24 | 119 |

Other Embodiments

As described above, one embodiment of the invention is described but the fundamental structure of the invention is not limited to the structure described above. For example, the silicon single crystal substrate is mentioned as an example of the flow path formation substrate 10 in the embodiment described above. However, the invention is not particularly limited thereto and materials, such as an SOI substrate and glass, may be used, for example.

Furthermore, the piezoelectric element 300 in which the first electrode 60, the piezoelectric layer 70, and the second electrode 80 were successively laminated on the substrate (flow path formation substrate 10) is described as an example in the embodiment described above. However, the invention is not particularly limited thereto, and the invention is also applicable to a vertical vibration type piezoelectric element in which a piezoelectric material and an electrode formation material are alternately laminated so as to be elongated or contracted in the axial direction.

Figure 11:
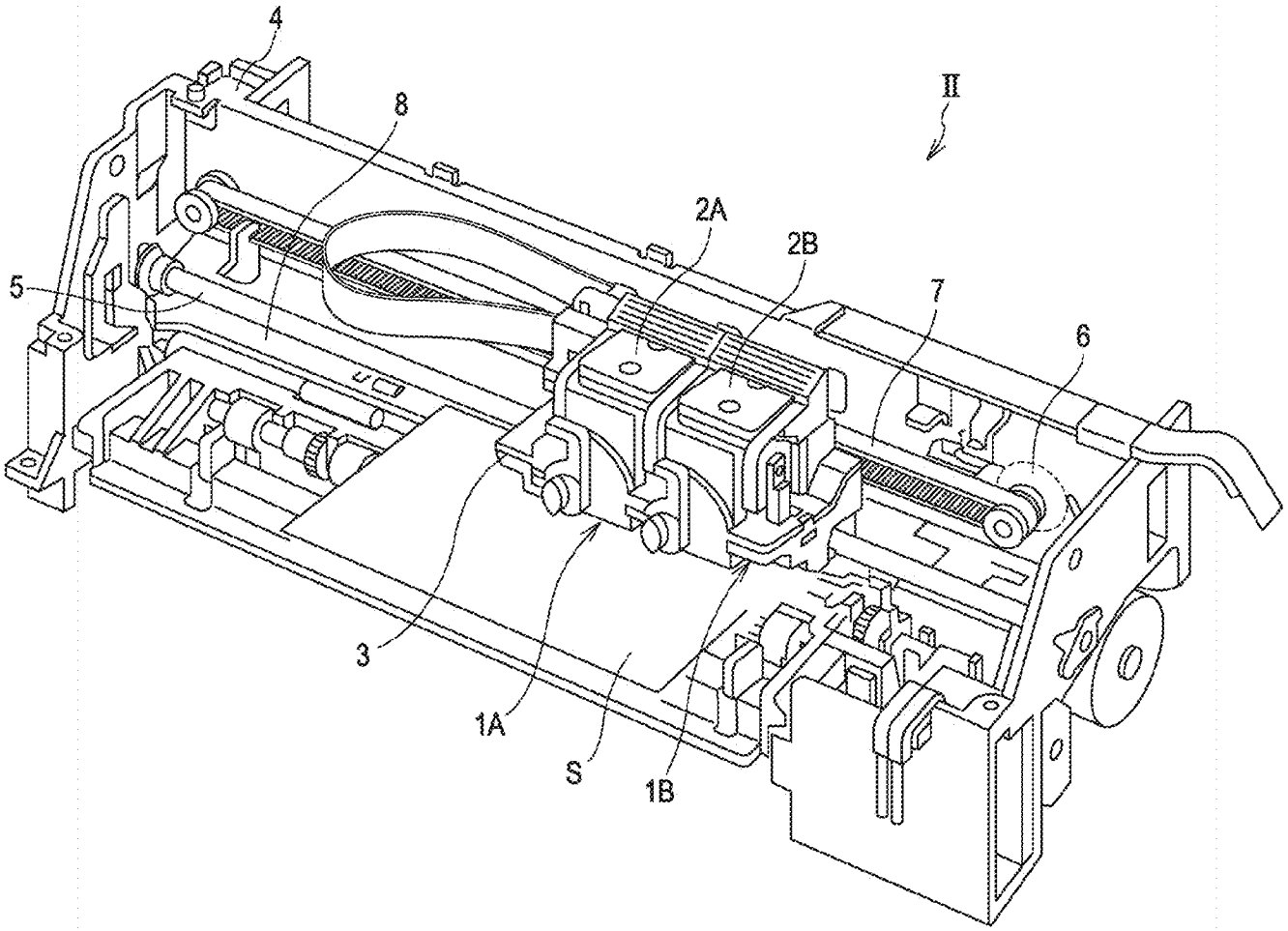
FIG. 11 is a view schematically illustrating the structure of a recording apparatus according to one embodiment of the invention.

The ink jet recording heads of these embodiments each constitute a part of a recording head unit having an ink flow path communicating with an ink cartridge or the like and is mounted in the ink jet recording apparatus. FIG. 11 is a schematic diagram illustrating an example of the ink jet recording apparatus.

In an ink jet recording apparatus II illustrated in FIG. 11, cartridges 2A and 2B which are used to constitute an ink supply unit are detachably provided in recording head units 1A and 1B having the ink jet recording head I, and a carriage 3 in which the recording head units 1A and 1B are mounted is provided on a carriage shaft 5 mounted to an apparatus body 4 in such a manner as to be movable in the axial direction. The recording head units 1A and 1B respectively discharge, for example, a black ink composition and a color ink composition, respectively.

As a driving force of a driving motor 6 is transmitted to the carriage 3 via a plurality of gears (not illustrated) and a timing belt 7, the carriage 3 in which the recording head units 1A and 1B are mounted is moved along the carriage shaft 5. On the other hand, a platen 8 is provided in the apparatus body 4 along the carriage shaft 5, and a recording sheet S which is a recording medium, such as paper, fed by a feed roller (not illustrated) is wound around the platen 8 to be transported.

In the embodiment described above, the ink jet recording head is described as an example of liquid ejecting heads. However, the invention is widely applied to general liquid ejecting heads, and it is a matter of course that the invention can also be applied to liquid ejecting heads that eject liquid other than ink. Mentioned as the other liquid ejecting heads are, for example, various recording heads for use in an image recording apparatus, such as a printer, a color material ejecting head used for manufacturing a color filter of a liquid crystal display or the like, an electrode material ejecting head used for forming an electrode of an organic EL display, an FED (field emission display), or the like, and a biological organic material ejecting head used for manufacturing biochips.

Moreover, the piezoelectric element according to an aspect of the invention is not limited to piezoelectric elements for use in liquid ejecting heads and can also be used for other devices. Mentioned as the other devices are, for example, ultrasonic devices, such as an ultrasonic transmitter, an ultrasonic motor, a temperature-electricity converter, a pressure-electricity converter, a ferroelectric transistor, a piezoelectric transformer, filters, such as a blocking filter for blocking harmful rays, such as infrared rays, an optical filter utilizing the photonic crystal effect by quantum dot formation, and an optical filter utilizing an optical interference of a thin film, and the like. Moreover, the invention is applicable also to a piezoelectric element to be used as a sensor and a piezoelectric element to be used as a ferroelectric memory. Mentioned as sensors to which the piezoelectric element is applied are, for example, an infrared sensor, an ultrasonic sensor, a thermal sensor, a pressure sensor, a pyroelectric sensor, a temperature sensor, a gyro sensor (angular velocity sensor), and the like.

What is claimed is:

1. A piezoelectric element, comprising:
a piezoelectric layer; and
an electrode disposed on the piezoelectric layer,
the piezoelectric layer containing a complex oxide containing bismuth, iron, barium, and titanium and having a perovskite structure, having a yield stress of 5.66 GPa or more, and having a Young's modulus of 114 GPa or more, wherein the piezoelectric layer is fired at a temperature greater than 700° C.

2. A piezoelectric element according to claim 1, wherein the piezoelectric layer further contains Mn, Co, and Cr.

3. A liquid ejecting head comprising the piezoelectric element according to claim 2.

4. A liquid ejecting apparatus comprising the liquid ejecting head according to claim 3.

* * * * *